US007473083B2

(12) United States Patent
Oh et al.

(10) Patent No.: US 7,473,083 B2
(45) Date of Patent: Jan. 6, 2009

(54) OIL SEPARATING DEVICE FOR COMPRESSOR

(75) Inventors: Hae-Jin Oh, Gyeongsangnam-Do (KR); Cheol-Hwan Kim, Seoul (KR); Hong-Gyun Jin, Gyeongsangnam-Do (KR); Chan-Hwa Jeong, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/717,051

(22) Filed: Mar. 13, 2007

(65) Prior Publication Data

US 2007/0217936 A1 Sep. 20, 2007

(30) Foreign Application Priority Data

Mar. 14, 2006 (KR) ..... 10-2006-0023717

(51) Int. Cl.
*F04C 2/00* (2006.01)
*F04C 15/00* (2006.01)
*F03C 2/00* (2006.01)

(52) U.S. Cl. ..... 418/55.6; 418/94; 418/97; 418/151; 418/270; 418/DIG. 1; 184/6.16; 184/6.18

(58) Field of Classification Search ..... 418/55.1–55.6, 418/57, 94, 97, 151, 270, DIG. 1; 184/6.18
See application file for complete search history.

(56) References Cited

U.S. PATENT DOCUMENTS 4,592,703 A * 6/1986 Inaba et al. ..... 418/94
2004/0179967 A1* 9/2004 Morozumi et al. ..... 418/55.1
2006/0078452 A1* 4/2006 Park et al. ..... 418/55.6

FOREIGN PATENT DOCUMENTS

JP 62118088 A * 5/1987 ..... 418/88
JP 04308381 A * 10/1992 ..... 418/151

* cited by examiner

*Primary Examiner*—Theresa Trieu
(74) *Attorney, Agent, or Firm*—Ked & Associates, LLP

(57) ABSTRACT

A scroll compressor including an oil separator is provided. The oil separator may be provided with a rotor or a shaft of a driving motor of the compressor so that refrigerant gas and oil discharged from a compression chamber may be separated by a centrifugal force. The oil separator may include a plurality of oil separation holes formed in an eccentric mass and a rotor. Rotation of the shaft/rotor and subsequent rotation of the eccentric mass generates a centrifugal force, causing separation of oil from refrigerant gas contained in the oil separation holes. Accordingly, oil is maintained in the casing, and is prevented from being discharged out of the compressor, thus preventing abrasion due to oil deficiency and a degradation in reliability of the compressor. Furthermore, oil is prevented from being discharged to a refrigerating system externally coupled to the compressor, thereby enhancing performance of the refrigerating system.

26 Claims, 9 Drawing Sheets

OIL SEPARATING DEVICE FOR COMPRESSOR

This claims priority to Korean Application No. 10-2006-0023717, filed in Korea on Mar. 14, 2006, the entirety of, which is incorporated herein by reference.

BACKGROUND

1. Field

This relates to a compressor, and more particularly, to a scroll compressor.

2. Background

Compressors convert mechanical energy into compressive energy. Compressors may be classified into a variety of types, including reciprocating, scroll, centrifugal and vane types. Scroll compressors may be further classified into low pressure and high pressure types, based on whether a suction or a discharge gas is filled in a casing thereof. In a scroll compressor, two scrolls perform a relative orbiting motion, and a pair of symmetrical compression chambers are formed between the two scrolls. As the compression chambers consecutively move towards a center of the scroll, a volume of the compression chamber is decreased, thus compressing a refrigerant held therein.

In order to maintain adequate performance and efficiency, a lubricant, such as, for example, oil, may be used to lubricate the moving, or friction parts of such a compressor. However, release of this type of lubricant into the compression/refrigeration system formed by such a compressor can degrade performance and efficiency of the compressor.

BRIEF DESCRIPTION OF THE DRAWINGS

The embodiments will be described in detail with reference to the following drawings in which like reference numerals refer to like elements wherein.

DETAILED DESCRIPTION

Figure 1:
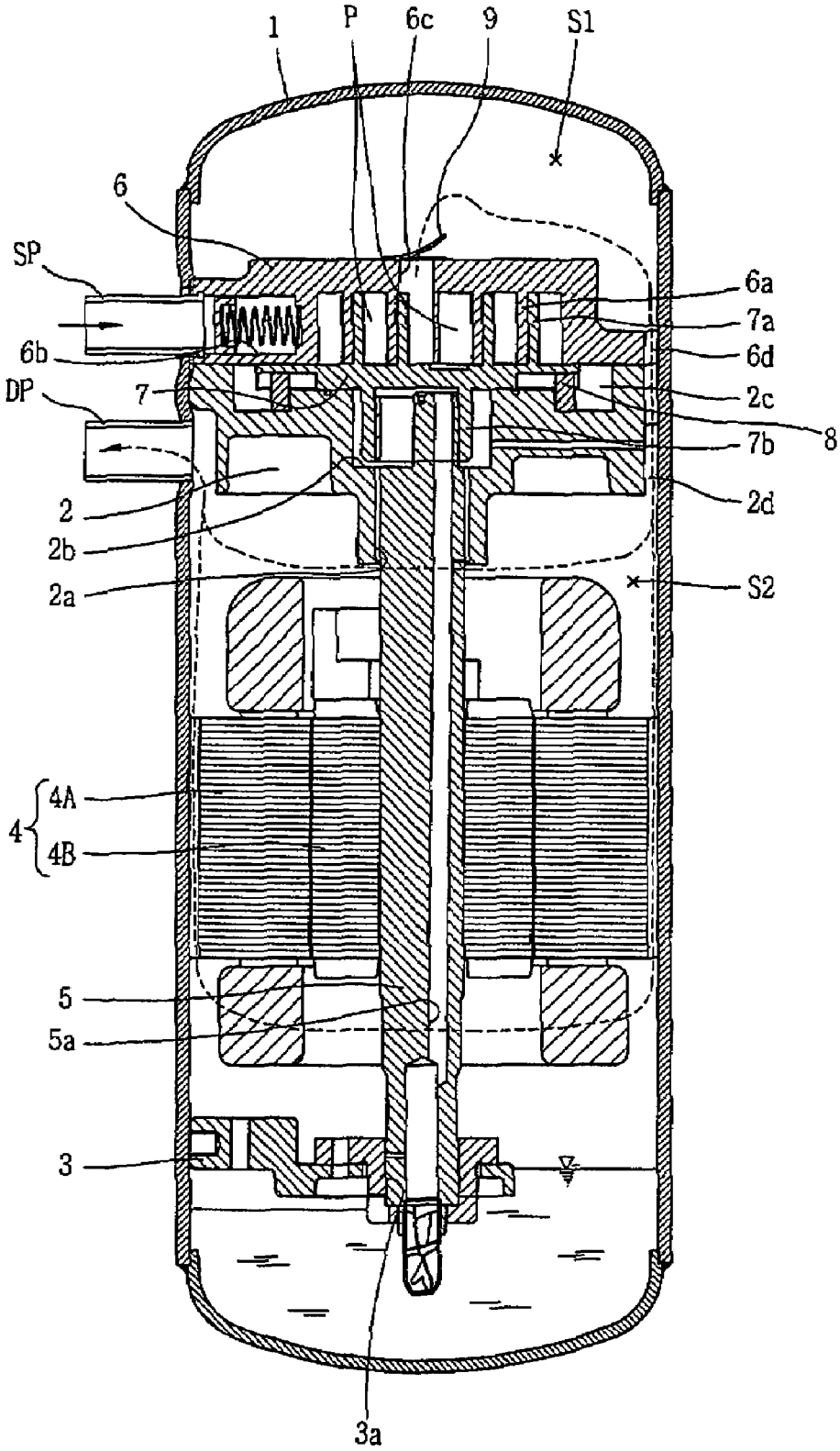
FIG. 1 is a sectional view of an exemplary high pressure type scroll compressor.

The exemplary high pressure type scroll compressor shown in FIG. 1 includes a casing 1 capable of maintaining a high pressure state, and having a gas suction pipe SP and a gas discharge pipe DP. A main frame 2 and a sub frame 3 may be fixed to upper and lower sides of the casing 1, respectively, and a driving motor 4 including a stator 4A and a rotor 4B may be mounted between the main frame 2 and the sub frame 3 to generate a rotation force. A driving shaft 5 including an oil passage 5*a* may extend up from a shaft hole 3*a* in the sub-frame 3 and be forcibly fitted into the center of a rotor 4B so as to transmit the rotation force generated by the driving motor 4 to an orbiting scroll 7 via the main frame 2. A fixed scroll 6 may be fixed to an upper surface of the main frame 2 so as to be directly connected the gas suction pipe SP. The orbiting scroll 7 may be orbitably disposed on an upper surface of the main frame 2 so as to be engaged with the fixed scroll 6 and form a plurality of compression chambers P. An Oldham's ring 8 may be disposed between the orbiting scroll 7 and the main frame 2 so as to cause the orbiting scroll 7 to orbit, and not rotate.

The gas suction pipe SP may be connected to an inlet 6*b* of the fixed scroll 6 via the casing 1, and the gas discharge pipe DP may be connected to an inner space of the casing 1 that is positioned at an opposite side of the fixed scroll 6 from the main frame 2. The main frame 2 may include a shaft hole 2*a* that supports the driving shaft 5. A high back pressure groove 2*b* may be provided at an upper side of the shaft hole 2*a* to receive high pressure oil to support the orbiting scroll 7. A middle back pressure groove 2*c* may be formed at an edge of an upper surface of the main frame 2. The middle back pressure groove 2*c* may form an interior space together with a rear surface of the orbiting scroll 7 to receive middle pressure oil.

An outer circumferential surface of the main frame 2 may be coupled to an inner circumferential surface of the casing 1 by welding or other appropriate attachment means. A plurality of gas connection grooves 2*d* for introducing gas discharged through the fixed scroll 6 to the gas discharge pipe DP may be formed at the outer circumferential surface of the main frame 2.

A fixed wrap 6*a* with an involute shape formed at a lower surface of a plate of the fixed scroll 6, and the inlet 6*b* to which the gas suction pipe SP may be connected is formed at a side surface of the plate. An outlet 6*c* through which a refrigerant compressed at the center of the fixed wrap 6*a* is discharged to an upper space S1 of the casing 1 may be formed at the center of an upper surface of the plate. The outlet 6*c* may be opened/closed by a backflow preventing valve 9. A gas pass groove 6*d* may be formed at an edge of the plate so as to be connected to the gas connection groove 2*d* of the main frame 2.

An orbiting wrap 7*a* with an involute shape may be formed at an upper surface of a plate of the orbiting scroll 7. A boss portion 7*b* that receives a driving force of the driving motor 4 by being coupled to the driving shaft 5 may be formed at the center of a lower surface of the plate. The boss portion 7*b* of the orbiting scroll 7 may be inserted into the high back pressure groove 2*b* of the main frame 2 so as to perform an orbiting motion.

When power is supplied to the driving motor 4, the driving shaft 5 rotates together with the rotor 4B, and the Oldham's ring 8 causes the orbiting scroll 6 to orbit on an upper surface of the main frame 2 by a predetermined eccentric distance. A pair of compression chambers P that move towards the center of the scroll are consecutively formed between the fixed wrap 6*a* of the fixed scroll 6 and the orbiting wrap 7*a* of the orbiting scroll 7. The compression chambers P decrease in volume as they approach the center of the scroll as the orbiting scroll 7 continuously orbits, thereby drawing in, compressing, and discharging refrigerant gas.

More specifically refrigerant is sucked into the inlet 6*b* of the fixed scroll 6 through the gas suction pipe SP is compressed in the compression chamber P, and is discharged to the upper space S1 in the casing 1 through the outlet 6*c* of the fixed scroll 6. The refrigerant is guided to a lower space S2 of the casing 1 via the gas pass groove 6*d* of the fixed scroll 6 and the gas connection groove 2*d* of the main frame 2. The refrigerant is then discharged to a refrigerating system through the gas discharge pipe DP.

When the driving shaft 5 rotates, oil is drawn into the oil passage 5*a* from a bottom portion of the casing 1 by a centrifugal force and is supplied to various lubricating surfaces. The oil lubricates the lubricating surfaces, and then is recollected at the bottom portion of the casing 1 together with oil which has been separated from the refrigerant discharged from the compression chamber P. However, the refrigerant discharged to the gas discharge pipe DP may still contain a large amount of oil which is subsequently is discharged to the refrigerating system along with the refrigerant. Accordingly, an amount of the oil left inside the compressor for lubrication is decreased, thus causing abrasion at various friction portions of the compressor and degrading its reliability. Furthermore, if an excessive amount of oil is introduced into the refrigerating system, performance of the refrigerating system may also be degraded.

Figure 2:
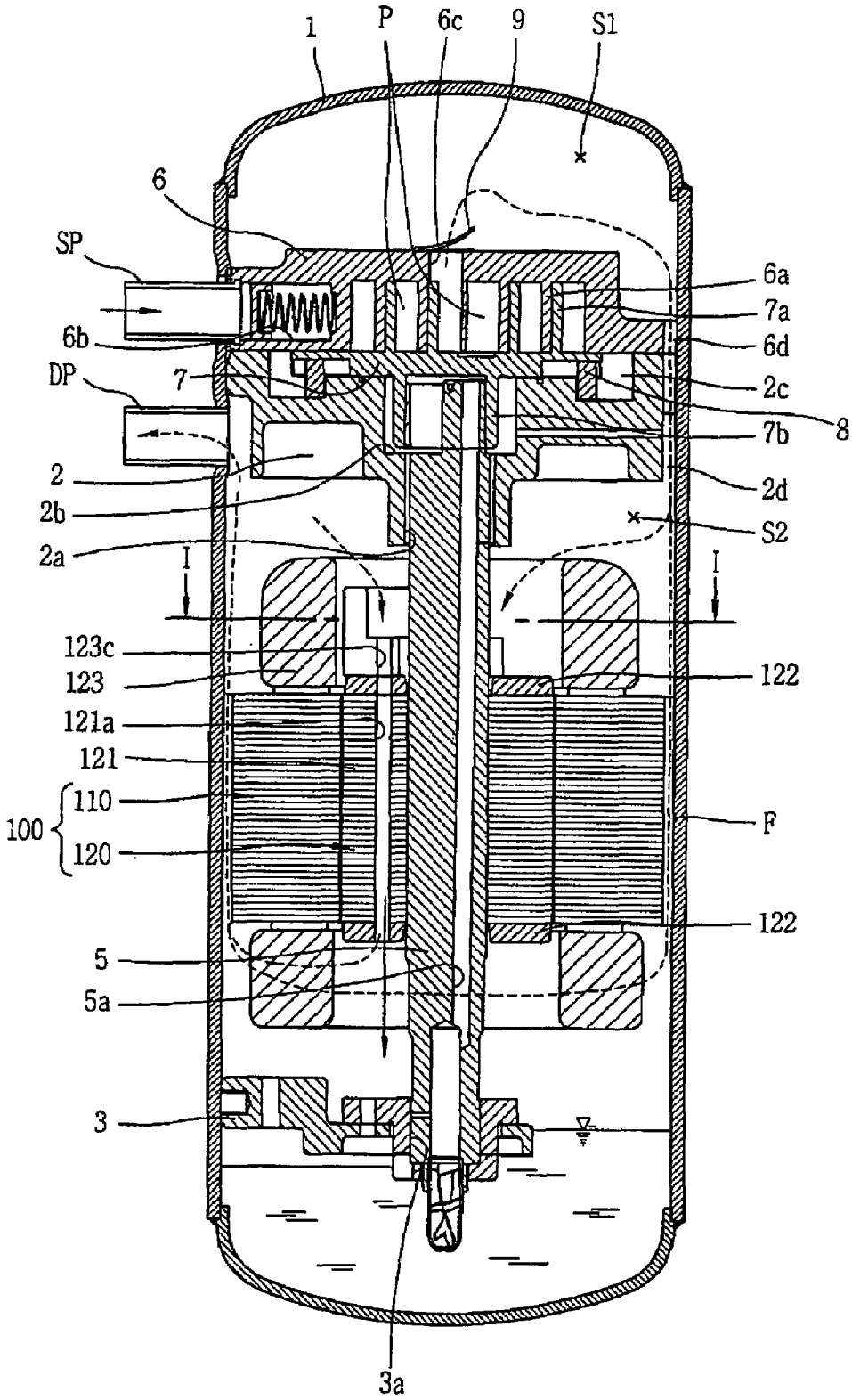
FIG. 2 is a sectional view of an exemplary a high pressure type scroll compressor in accordance with embodiments as broadly described herein.

The exemplary high pressure type scroll compressor shown in FIG. 2 may include a casing 1 forming a hermetic inner space and containing a certain amount of oil, and a main frame 2 and a sub frame 3 fixed to upper and lower sides of the casing 1, respectively. A driving motor 100 including a stator 110 and a rotor 120 may be provided between the main frame 2 and the sub frame 3 to generate a rotation force, and may include an oil separator for separating oil from a refrigerant-oil mixture discharged from a compression chamber P. A driving shaft 5 forcibly fitted into the center of the rotor 120 to transmit the rotation force generated by the driving motor 100 to an orbiting scroll 7 via the main frame 2. A fixed scroll 6 may be fixed to an upper surface of the main frame 2, and may include an outlet 6*c* facing an upper space S1 of the casing 1. The orbiting scroll 7 may be eccentrically coupled to the driving shaft 5 so as to perform an orbiting motion on an upper surface of the main frame 2 through its inter-engagement with the fixed scroll 6 to form pair of compression chambers P. An Oldham's ring 8 may be disposed between the orbiting scroll 7 and the main frame 2 so as to cause the orbiting scroll 7 to orbit, and not rotate.

A gas suction pipe SP may be directly connected to the fixed scroll 6, and a gas discharge pipe DP may be connected to a lower space S2 of the casing 1 between the main frame 2 and the driving motor 100 so that a compressed refrigerant may be discharged to a refrigerating cycle connected thereto.

The main frame 2 and the subframe 3 may include shaft holes 2*a* and 3*a*, respectively, that support the driving shaft 5. A high back pressure groove 2*b* may be provided at an upper side of the shaft hole 2*a* to receive high pressure oil to support the orbiting scroll 7. A middle back pressure groove 2*c* may be formed at an edge of an upper surface of the main frame 2. The middle back pressure groove 2*c* may form an interior space together with a rear surface of the orbiting scroll 7 to receive middle pressure oil.

An outer circumferential surface of the main frame 2 may be coupled to an inner circumferential surface of the casing 1 by welding or other appropriate attachment means. A plurality of gas connection grooves 2*d* provide for communication between the upper space S1 and the lower space S2 of the casing 1, and may be formed along the outer circumferential surface of the main frame 2.

The stator 110 may be fixed to an inner circumferential surface of the casing 1, and the rotor 120 may be rotatably coupled to an inside of the stator 110 while maintaining a predetermined gap. A refrigerant channel F may be formed between an outer circumferential surface of the stator 110 and the inner circumferential surface of the casing 1. The channel F may guide refrigerant gas from a lower side of the driving motor 100 to an upper side of the driving motor 100 so as to be discharged through the gas discharge pipe DP.

The rotor 120 may include a laminator 121 formed by a plurality of stator cores that are laminated to one another, and upper and lower end rings 122 coupled to upper and lower ends of the laminator 121. An eccentric mass 123 that compensates for an eccentric movement of the driving shaft 5 may be fixed to the upper and lower rings 122, or to only the upper ring 122.

A plurality of second oil separating holes 121*a* formed in the laminator 121 may be connected to a plurality of first oil separating holes 123*c* formed in the eccentric mass 123 to separate oil from refrigerant gas in a mixture thereof. In certain embodiments, the second oil separating holes 121*a* may have a diameter larger than that of the first oil separating holes 123*c* so as to smoothly separate oil from the refrigerant gas. In alternative embodiments, the second oil separating holes 121*a* may be formed in the same direction as the rotation direction of the rotor 120, or may be formed such that a sectional surface increases downwardly.

Figure 3:
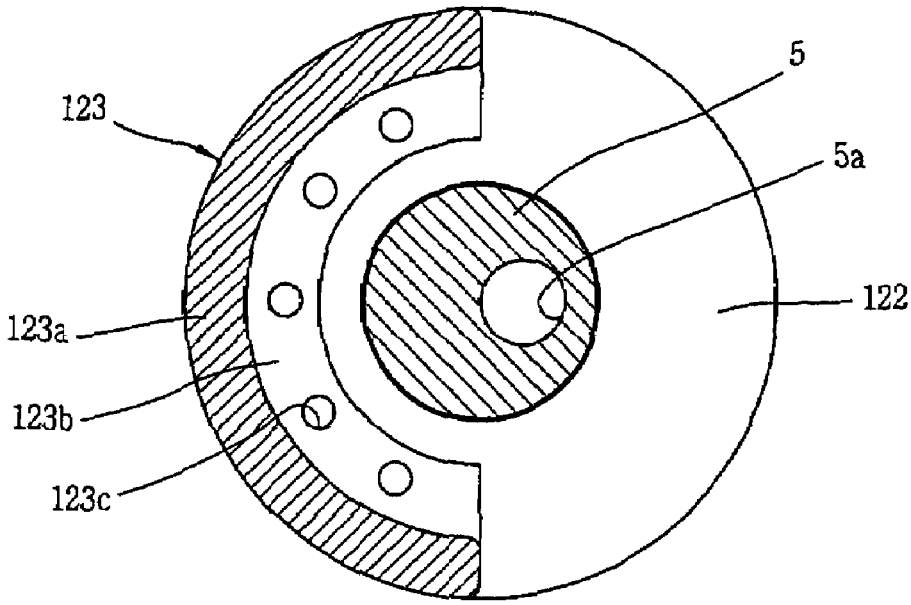
FIG. 3 is a sectional view taken along line 'I-I' of FIG. 2.
Figure 4:
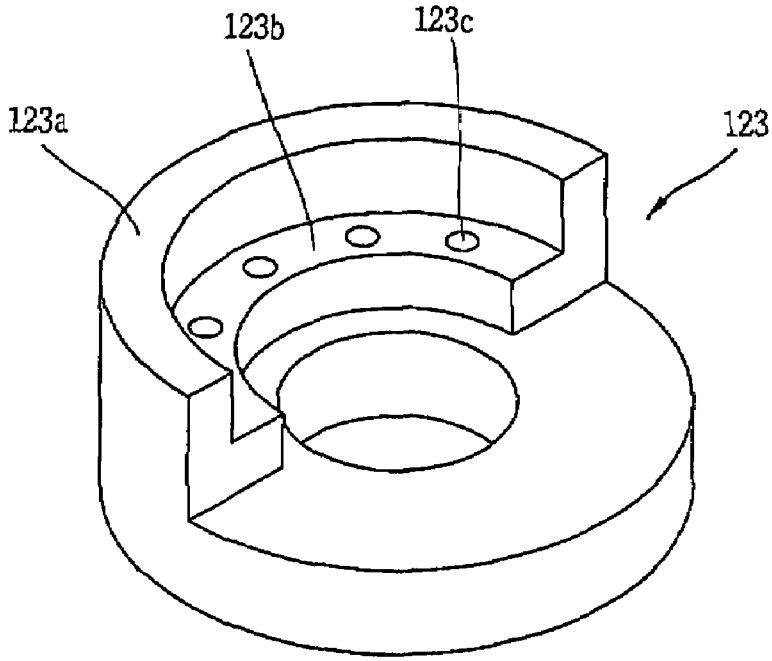
FIG. 4 is a perspective view of an eccentric mass of the exemplary compressor shown FIG. 2.

As shown in FIGS. 3 and 4, the eccentric mass 123 may include a first eccentric portion 123*a* having a circular arc shape to collect refrigerant gas and oil that move towards the lower space S2 of the casing 1. The eccentric mass 123 may also include second eccentric portion 123*b* formed at an inner side of the first eccentric portion 123*a*, and may have a height lower than that of the first eccentric portion 123*a*. The plurality of the first oil separating holes 123*c* that guide refrigerant gas and oil into the laminator 121 may penetrate the second eccentric portion 123*b* along a circumferential direction.

Operation of the scroll compressor as described above will now be explained.

When power is supplied to the driving motor 100, the driving shaft 5 is rotated together with the rotor 120, and the orbiting scroll 7 is orbited a predetermined eccentric distance. As the orbiting scroll 7 moves within the fixed scroll 6, a plurality of paired compression chambers P having decreased volumes towards the center of the scroll are formed. Accordingly, refrigerant gas is drawn in, compressed, and discharged, and this process is continuously repeated.

The refrigerant gas is drawn into the compression chamber P through the suction pipe SP connected to an inlet 6*b* of the fixed scroll 6, is compressed, and then is discharged to the upper space S1 of the casing 1 through an outlet 6*c* of the fixed scroll 6. The refrigerant gas discharged to the upper space S1 of the casing 1 is guided towards the lower space S2 of the casing 1 via the gas pass groove 6*d* and the gas connection groove 2*d*, and then is introduced into the second oil separating holes 121*a* of the laminator 121 via the first oil separating holes 123*c* provided at the eccentric mass 123 of the rotor 120. Then, the refrigerant gas, which may contain some oil, passes through the second oil separating holes 123*a*, where oil is separated from the refrigerant by a centrifugal force.

Figure 5:
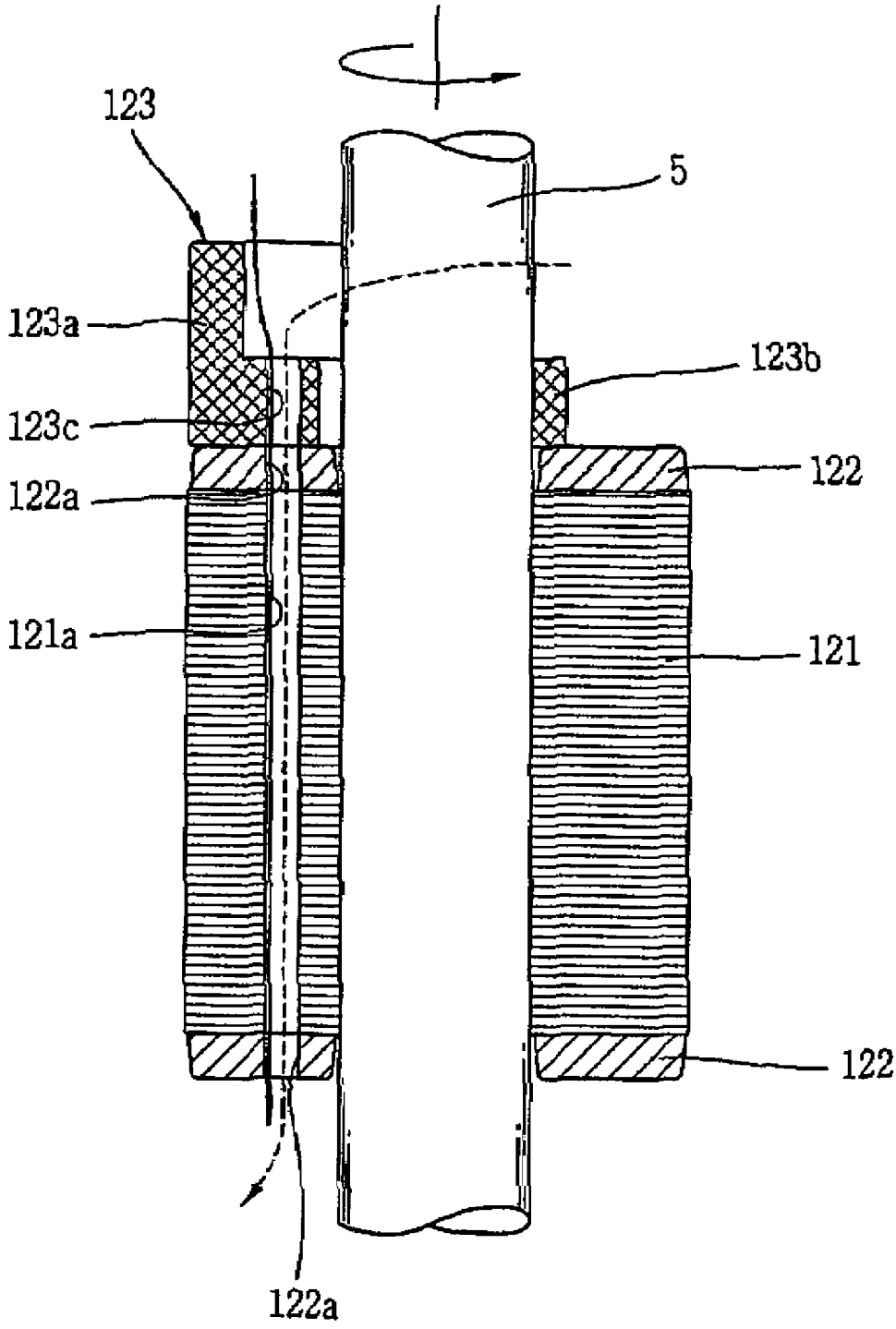
FIG. 5 is a sectional view of a portion of the exemplary compressor shown in FIG. 2 in a state that oil is separated from refrigerant gas by the eccentric mass shown in FIG. 4.

More specifically, as shown in FIG. 5, when the refrigerant gas is drawn into the compression chamber P, oil mixed with the refrigerant gas may also be drawn into the compression chamber P. The oil is discharged to the upper space S1 of the casing 1 together with the compressed refrigerant gas, and is guided toward the lower space S2. The refrigerant gas and the oil having moved to the lower space S2 are collected by the first eccentric portion 123*a* of the eccentric mass 123, thereby being introduced into the first oil separating holes 123*c* provided at the second eccentric portion 123*b*. From the first oil separating holes 123*c*, the refrigerant gas and the oil flow into the second oil separating holes 121*a* in the stator laminator 121, and thus are separated from each other by a centrifugal force. The oil is recollected in the lower space S2 of the casing 1, while the refrigerant gas passes through the second oil separating holes 121*a* and is discharged to the refrigerating system via the gas discharge pipe DP.

In this first embodiment, the circular-arc shaped first eccentric portion 123*a* of the eccentric mass 123 introduces refrigerant gas and oil to the first oil separating holes 123*c*. However, in the second embodiment shown in FIGS. 6 and 7, a cylindrical guide portion is further provided on an outer circumferential surface of an eccentric portion, and introduces refrigerant gas and oil to the first oil separating holes.

Figure 6:
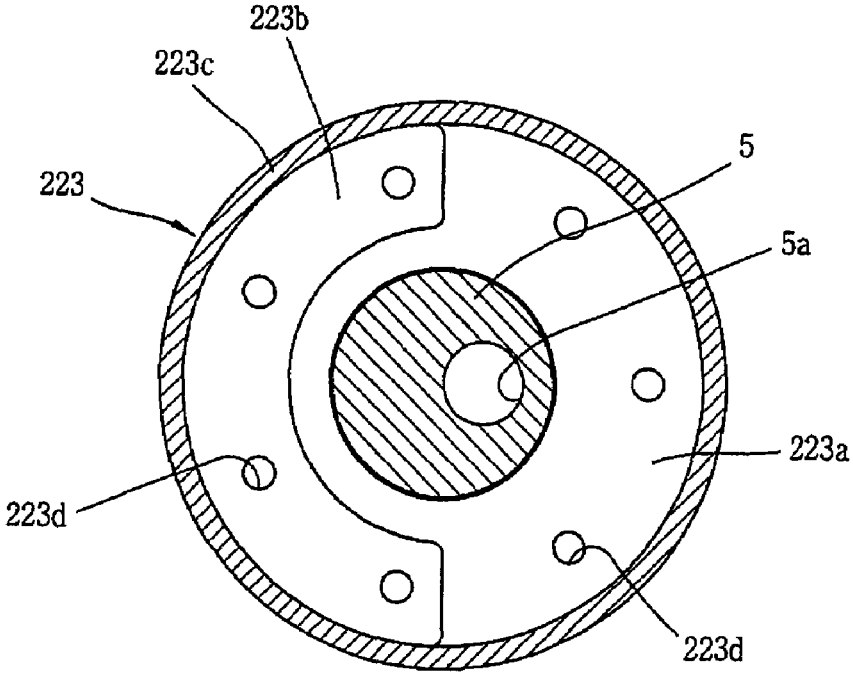
FIGS. 6 and 7 are a planar view and a perspective view, respectively, of an eccentric mass of the exemplary compressor shown in FIG. 2 in accordance with another embodiment as broadly described herein.
Figure 7:
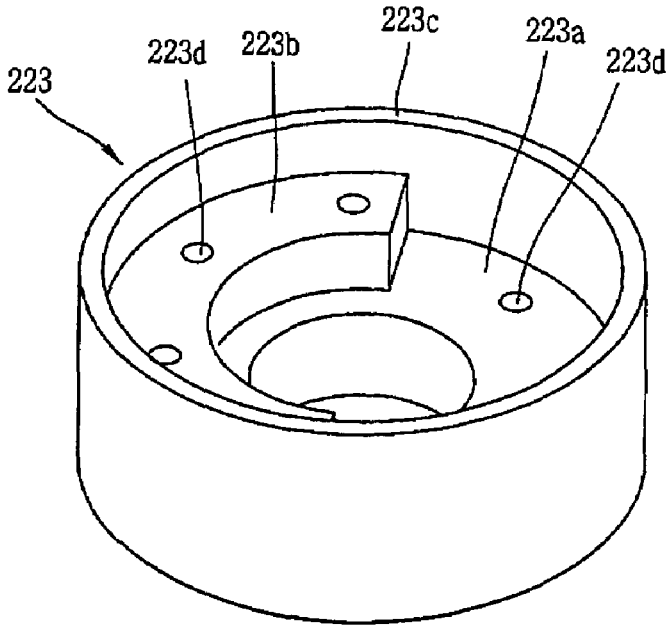

More specifically, the eccentric mass 223 shown in FIGS. 6 and 7 may include a body portion 223*a* having a ring shape, an eccentric portion 223*b* protruding from the body portion 223*a* and having a circular arc shape, and a guide portion 223*c* disposed on an outer circumferential surface of the eccentric portion 223*b* and an outer circumferential surface of the body portion 223*a*, and having a cylindrical shape. In certain embodiments, guide portion 223*c* may have a height higher than that of the body portion 223*a* and the eccentric portion 223*b* so that refrigerant gas and oil may be collected into the guide portion 223*c*. A plurality of first oil separating holes 223*d* that guide refrigerant gas and oil to the second oil separating holes 121*a* of the laminator 121 may penetrate the body portion 223*a* and the eccentric portion 223*b*. The first oil separating holes 223*d* may be formed in a shaft direction, with the same interval therebetween, along a circumferential direction of the body 223*a* and the eccentric portion 223*b*.

By providing the cylindrical guide portion 223*c* at a periphery of the eccentric mass 223, a large amount of refrigerant gas and oil that move to the lower space S2 of the casing 1 can be introduced into the first oil separating holes 223*d*. Accordingly, an amount of the oil separated from the refrigerant gas can be increased.

Figure 8:
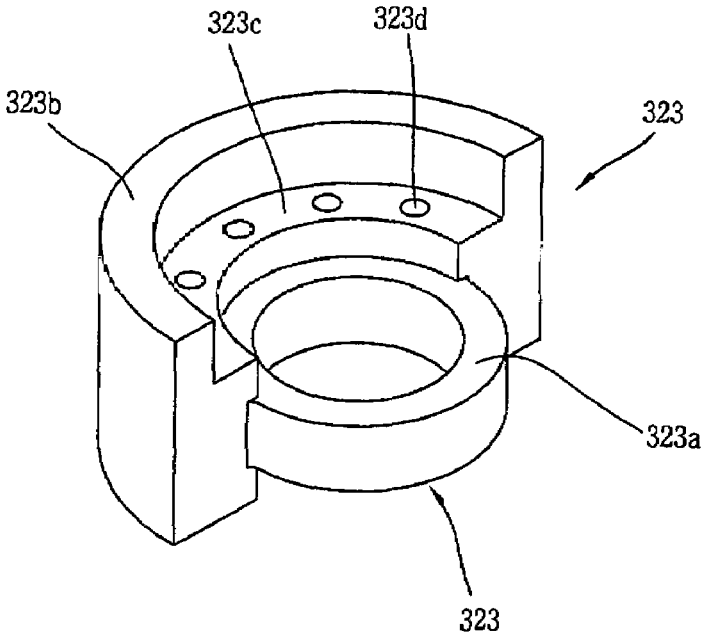
FIG. 8 is a perspective view of an eccentric mass of the exemplary compressor shown in FIG. 2 in accordance with another embodiment as broadly described herein.

The eccentric mass is coupled to the rotor in the first and second embodiments. However, the eccentric mass may instead be coupled to the driving shaft, as will be explained with respect to the third embodiment shown in FIGS. 8 and 9. More specifically, the eccentric mass 323 shown in FIGS. 8 and 9 may include a fixed portion 323*a* having a ring shape so as to be coupled to the driving shaft 5, a first eccentric portion 323*b* protruding from the fixed portion 323*a* and having a circular arc shape, a second eccentric portion 323*c* disposed at an inner side of the first eccentric portion 323*b* as a step, and having a circular arc shape, and a plurality of first oil separating holes 323*d* that penetrate the second eccentric portion 323*c* in a shaft direction to separate refrigerant gas and oil by a centrifugal force. The eccentric mass 323 may be coupled to an upper end of the driving shaft 5 that is positioned at a lower side of the driving motor 100.

Figure 9:
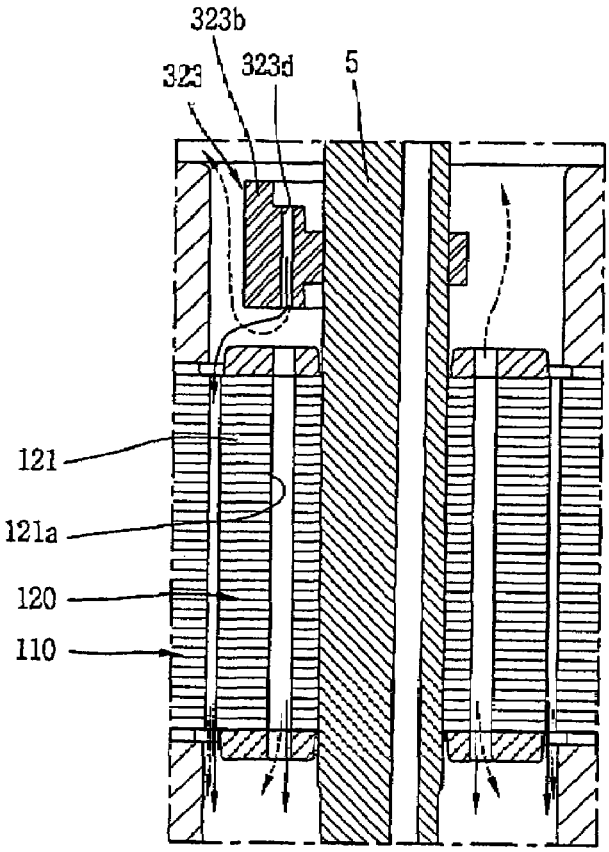
FIG. 9 is a sectional view of a portion of the exemplary compressor shown in FIG. 2 in a state that oil is separated from refrigerant gas by the eccentric mass shown in FIG. 8.

As shown in FIG. 9, the refrigerant gas and the oil that move towards the lower space S2 of the casing 1 may be collected by the first eccentric portion 323*b* of the eccentric mass 323 and guided to the first oil separating holes 323*d* of the second eccentric portion 323*c*. Then, the refrigerant gas and the oil are separated from each other by a centrifugal force while passing through the first oil separating holes 323*d*. Some of the separated refrigerant gas is moved to the gas discharge pipe DP, and the refrigerant gas and the oil having not been separated from each other are guided to the second oil separating holes 121*a* of the laminator 121. Accordingly, the remaining refrigerant and oil are then separated from each other at the second oil separating holes 121*a*, and the oil is recollected at the lower space S2 of the casing 1. Some of the oil separated from the refrigerant gas at the first oil separating holes 323*d* may be used by a coil 80 of the driving motor 100, and is recollected to the lower space S2 of the casing 1 via an air gap between the stator 110 and the rotor 120, thereby enhancing a cooling efficiency of the driving motor and increasing a recollected amount of oil.

The refrigerant gas and the oil discharged from the compression chamber P may be separated from each other by a centrifugal force, thereby preventing oil inside the casing from being discharged outside the casing. Accordingly, abrasion of the various frictional components of the compressor may be prevented, and a performance and reliability of the compressor is maintained. Furthermore, oil may be prevented from being contained in a pipe channel leading to a refrigerating system to which the compressor is connected, thereby enhancing performance of the refrigerating system.

Figure 10:
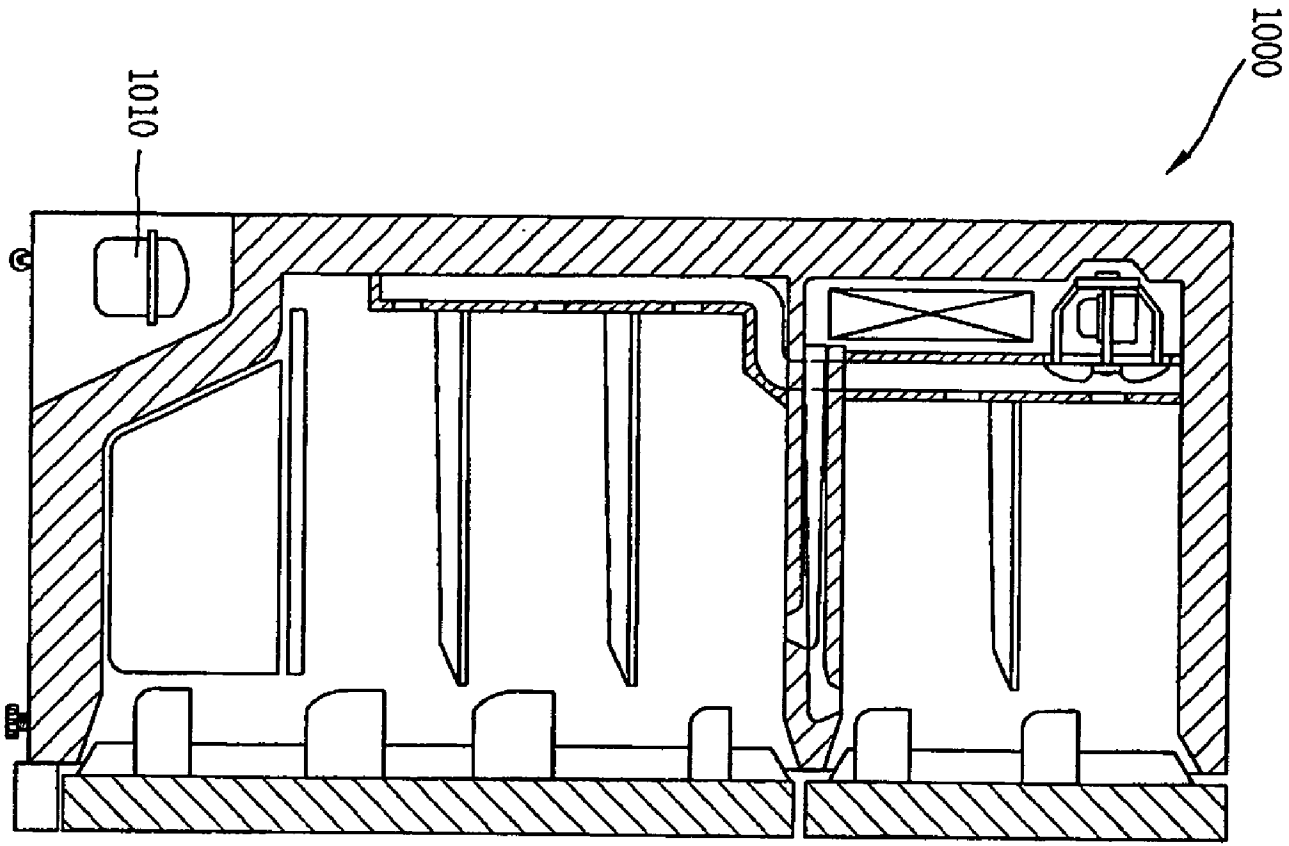
FIGS. 10-12 illustrate exemplary installations of a compressor as embodied and broadly described herein.

The oil separation system for a scroll compressor as embodied and broadly described herein has numerous applications in which compression of fluids is required, and in different types of compressors. Such applications may include, for example, air conditioning and refrigeration applications. One such exemplary application is shown in FIG. 10, in which a compressor 1010 as embodied and broadly described herein is installed in a refrigerator/freezer 1000. Installation and functionality of a compressor in this type of refrigerator is discussed in detail in U.S. Pat. Nos. 7,082,776, 6,995,064, 7,114,345, 7,055,338 and 6,772,601, the entirety of which are incorporated herein by reference.

Figure 11:
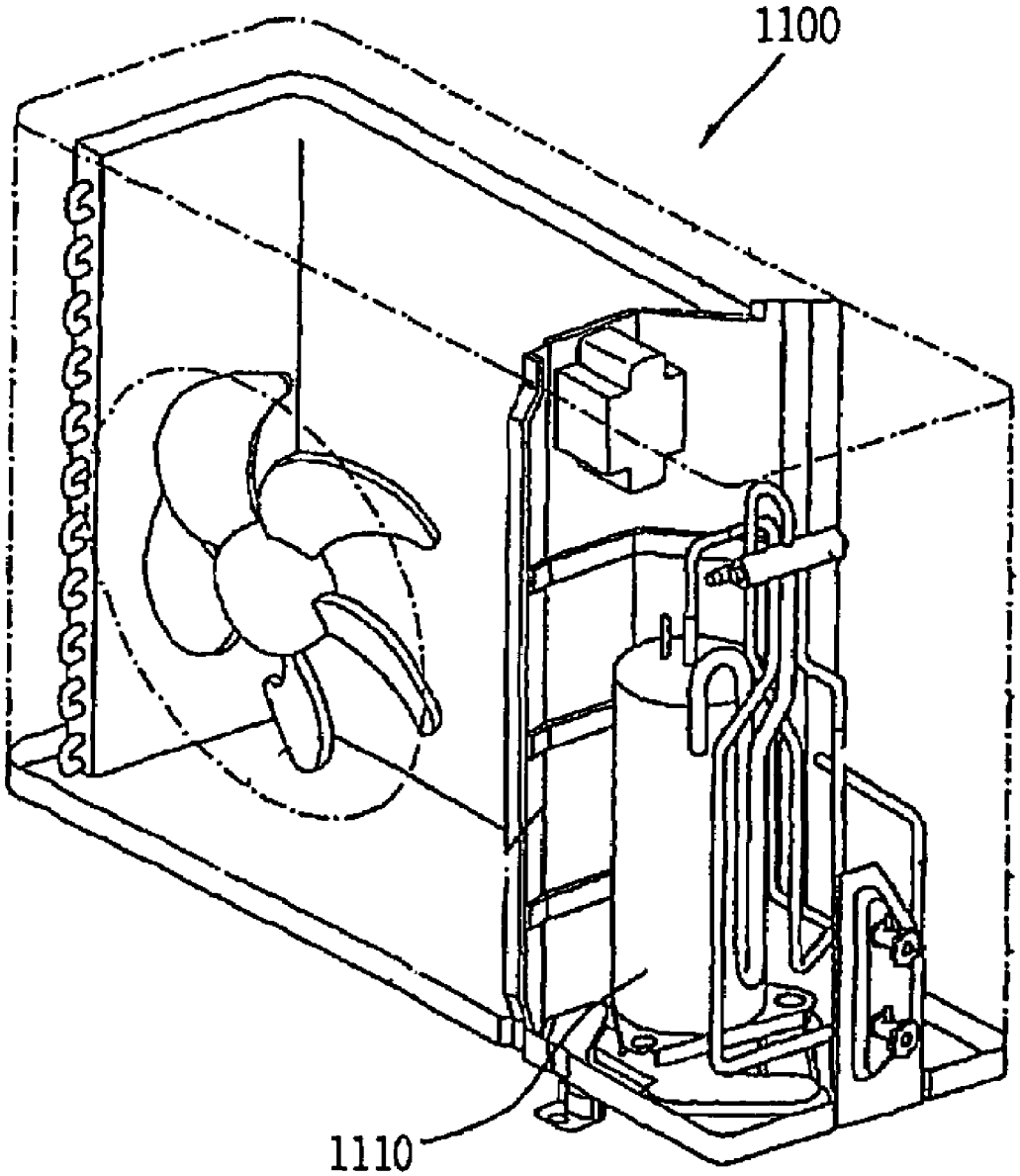

Another such exemplary application is shown in FIG. 11, in which a compressor 1110 as embodied and broadly described herein is installed in an outdoor unit of an air conditioner 1100. Installation and functionality of a compressor in this type of air conditioner is discussed in detail in U.S. Pat. Nos. 7,121,106, 6,868,681, 5,775,120, 6,374,492, 6,962,058, 6,951,628 and 5,947,373, the entirety of which are incorporated herein by reference.

Figure 12:
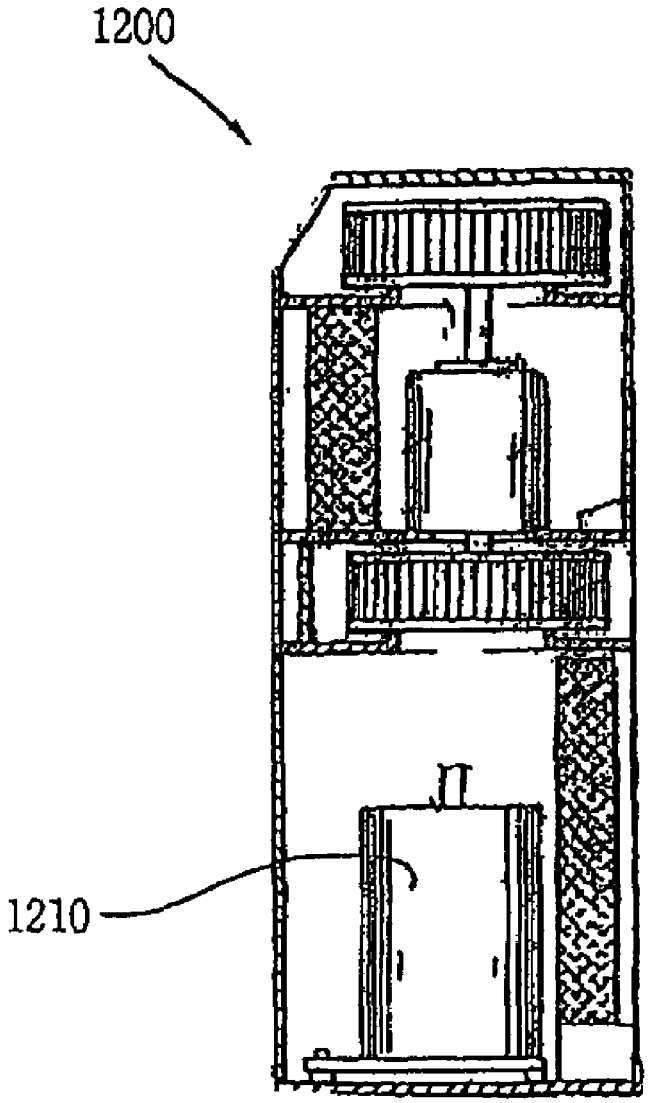

Another such exemplary application is shown in FIG. 12, in which a compressor 1210 as embodied and broadly described herein is installed in a single, integrated air conditioning unit 1200. Installation and functionality of a compressor in this type of air conditioner is discussed in detail in U.S. Pat. Nos. 7,032,404, 6,412,298, 7,036,331, 6,588,288, 6,182,460 and 5,775,123, the entirety of which are incorporated herein by reference.

An object is to provide a scroll compressor capable of easily separating oil from a refrigerant discharged from a compressor.

To achieve these and other advantages and in accordance embodiments broadly described herein, there is provided a scroll compressor, including a casing containing oil, a driving motor disposed in the casing, and generating a rotation force, a driving shaft that transmits the rotation force from the driving motor, a compression unit eccentrically coupled to the driving shaft, and forming a compression chamber by two scrolls, and an eccentric mass coupled to a rotor of the driving motor or the driving shaft, and having an oil separator that separates refrigerant gas from oil in the casing.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiments, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor having an oil separating device, the compressor comprising:

a casing;

a motor comprising a rotor and a stator provided in the casing and configured to generate a rotation force;

a shaft coupled to the motor;

a compression unit having a compression chamber, wherein the compression unit is coupled to the shaft such that the shaft transmits the rotation force generated by the motor to the compression unit; and an eccentric mass coupled to the shaft, wherein the eccentric mass comprises a plurality of first oil separating holes penetrating the eccentric mass in a shaft direction to separate oil from refrigerant gas.

2. The compressor of claim 1, wherein the eccentric mass comprises an eccentric portion having an arcuate shape, wherein the plurality of first oil separating holes are provided at an inner side of the eccentric portion.

3. The compressor of claim 2, wherein the eccentric portion comprises an outer eccentric portion and an inner eccentric portion, wherein the outer eccentric portion extends higher than the inner eccentric portion, and wherein the plurality of first oil separating holes extend through the inner eccentric portion.

4. The compressor of claim 1, wherein the eccentric mass comprises a cylindrical body portion, a cylindrical guide portion surrounding an outer circumferential surface of the body portion, and an eccentric portion having an arcuate shape provided on a top surface of the body portion, at an inner side of the guide portion, wherein the plurality of first oil separating holes are provided in the eccentric portion.

5. The compressor of claim 1 wherein the eccentric mass comprises a cylindrical body portion, a cylindrical guide portion surrounding an outer circumferential surface of the body portion, and an eccentric portion having arcuate shape provided on a top surface of the body portion at an inner surface of the guide portion, wherein the plurality of first oil separating holes are arranged in a circumferential direction of the eccentric mass inside the guide portion.

6. The compressor of claim 5, wherein the eccentric portion only partially extends along a top peripheral surface of the body portion.

7. The compressor of claim 6, wherein the plurality of first oil separating holes comprises a plurality of first holes that extend through the eccentric portion and a corresponding portion of the body portion, and a plurality of second holes that extend through only the body portion.

8. The compressor of claim 1, further comprising a plurality of second oil separating holes that penetrate the rotor in a shaft direction.

9. The compressor of claim 8, wherein the plurality of second oil separating holes have a larger cross section than the plurality of first oil separating holes.

10. The compressor of claim 8, wherein the plurality of second oil separating holes formed in the rotor are positioned so as to be in communication with the plurality of first oil separating holes formed in the eccentric mass.

11. The compressor of claim 10, wherein the plurality of first oil separating holes formed in the eccentric mass and the plurality of second oil separating holes formed in the rotor are aligned with each other in a shaft direction.

12. The compressor of claim 1, further comprising a gas discharge pipe connected to the compression chamber formed in the compression unit, opposite a side of the compression unit that includes a refrigerant discharge pipe.

13. The compressor of claim 12, wherein the compression unit is configured to divide the casing an upper space and a lower space, and wherein the compression unit is configured to discharge the refrigerant gas to the upper space of the casing from the compression chamber, and to direct the discharged refrigerant gas to the lower space.

14. The compressor of claim 12, wherein the gas discharge pipe is provided between the motor and the compression unit.

15. The compressor of claim 14, wherein the motor is provided in the lower space, and wherein a channel is formed between an outer circumferential surface of the motor and an inner circumferential surface of the casing.

16. The compressor of claim 1, wherein the compression unit comprises a fixed scroll coupled to the casing, and an orbiting scroll movably coupled to the fixed scroll, with a compression space formed therebetween.

17. An oil separating device for compressor, comprising:

a casing;

a motor comprising a rotor and a stator provided in the casing and configured to generate a rotation force;

a shaft coupled to the motor;

a compression unit having a compression chamber, wherein the compression unit is coupled to the shaft such that the shaft transmits the rotation force generated by the motor to the compression unit; and an eccentric mass coupled to the shaft, wherein the eccentric mass comprises:

an eccentric portion having an arcuate shape, the eccentric portion comprising an outer eccentric portion and an inner eccentric portion, wherein the outer eccentric portion extends higher than the inner eccentric portion; and a plurality of first oil separating holes that extend in a shaft direction through the inner eccentric portion.

18. The compressor of claim 17, further comprising a plurality of second oil separating holes that penetrate the rotor in a shaft direction.

19. The compressor of claim 18, wherein the plurality of second oil separating holes have a larger cross section than the plurality of first oil separating holes.

20. The compressor of claim 18, wherein the plurality of second oil separating holes formed in the rotor are positioned so as to be in communication with the plurality of first oil separating holes formed in the eccentric mass.

21. The compressor of claim 20, wherein the plurality of first oil separating holes formed in the eccentric mass and the plurality of second oil separating holes formed in the rotor are aligned with each other in a shaft direction.

22. The compressor of claim 17, further comprising a gas discharge pipe connected to the compression chamber formed in the compression unit, opposite a side of the compression unit that includes a refrigerant discharge pipe.

23. The compressor of claim 22, wherein the compression unit is configured to divide the casing an upper space and a lower space, and wherein the compression unit is configured to discharge the refrigerant gas to the upper space of the casing from the compression chamber, and to direct the discharged refrigerant gas to the lower space.

24. The compressor of claim 22, wherein the gas discharge pipe is provided between the motor and the compression unit.

25. The compressor of claim 24, wherein the motor is provided in the lower space, and wherein a channel is formed between an outer circumferential surface of the motor and an inner circumferential surface of the casing.

26. The compressor of claim 17, wherein the compression unit comprises a fixed scroll coupled to the casing, and an orbiting scroll movably coupled to the fixed scroll, with a compression space formed therebetween.

* * * * *